US009266381B2

(12) United States Patent
Yen

(10) Patent No.: US 9,266,381 B2
(45) Date of Patent: Feb. 23, 2016

(54) PALM-PRESSING TEXT CORRECTION APPARATUS

(71) Applicant: MCAIDE ENTERPRISE CO., LTD., New Taipei (TW)

(72) Inventor: Ming-Hua Yen, New Taipei (TW)

(73) Assignee: MCAIDE ENTERPRISE CO., LTD., New Taipei (TW)

( * ) Notice: Subject to any disclaimer, the term of this patent is extended or adjusted under 35 U.S.C. 154(b) by 147 days.

(21) Appl. No.: 14/161,702

(22) Filed: Jan. 23, 2014

(65) Prior Publication Data

US 2015/0202913 A1 Jul. 23, 2015

(51) Int. Cl.
*B43L 19/00* (2006.01)
*B65D 83/00* (2006.01)

(52) U.S. Cl.
CPC ..... *B43L 19/0068* (2013.01); *B43L 19/0018* (2013.01); *B65D 83/0055* (2013.01)

(58) Field of Classification Search
CPC ..... B34K 8/143; B34K 8/14; B43L 19/0018; B43M 11/06; B65D 83/0055; B65D 83/0072
USPC ..... 401/153, 156, 159, 170
See application file for complete search history.

(56) References Cited

U.S. PATENT DOCUMENTS 2,009,761 A * 7/1935 Calderara ..... 222/92
2,129,119 A * 9/1938 Davis ..... B65D 1/0292 222/105
3,682,559 A * 8/1972 Hirota ..... A45D 34/042 401/198
4,043,681 A * 8/1977 Funahashi ..... B43K 5/1863 401/151
4,634,023 A * 1/1987 Tanaka et al. ..... 222/105
5,186,563 A * 2/1993 Gebhard ..... A46B 11/0027 401/153
5,915,872 A * 6/1999 Machida ..... B43K 5/1881 401/209
D456,844 S 5/2002 Oka
D648,798 S 11/2011 Shimizu
2012/0279995 A1 * 11/2012 Bugenske ..... B65D 83/0055 222/215

* cited by examiner

*Primary Examiner* — David Walczak
*Assistant Examiner* — Bradley Oliver
(74) *Attorney, Agent, or Firm* — Leong C. Lei

(57) ABSTRACT

A palm-pressing text correction apparatus manufactured according to the shape of a user's hand includes a casing, an elastic container and a pressing element. The casing has a first opening and a second opening formed at both ends of the casing respectively, and the elastic container is mounted into the casing and provided for containing correction liquid, and a liquid output nozzle and a pressed end are disposed at both ends of the casing respectively. The liquid output nozzle is protruded out from the first opening, and the pressing element is coupled to the pressed end. The apparatus is held within the user's palm operating range, and an axial force acted onto the pressing element is produced by a pressing force while holding the apparatus to compress the elastic container to deform in an axial direction and output the correction liquid with an effort-saving effect.

10 Claims, 6 Drawing Sheets

PALM-PRESSING TEXT CORRECTION APPARATUS

BACKGROUND OF THE INVENTION

1. Field of the Invention

The present invention relates to the field of text correction tools and more particularly to a palm-pressing text correction apparatus held by a user's palm for its use, and a pressing force of holding the apparatus controls the quantity of an outputted correction liquid.

2. Description of the Related Art

Text is the greatest mankind's invention ever that allows human civilization to be developed rapidly. In the meantime, various different pens were invented for writing text, but writing a wrong text may cause misunderstanding, so that text correction apparatuses such as erasers, correction liquids and correction tapes are also well developed as pens advance.

The correction liquid is a white opaque pigment coated on a correction surface to cover the wrong text. After the correction liquid is dried, the correct text can be written on top of the dried correction liquid. At present, the correction liquids available in the market come with different using methods according to the different containers. For example, a container with a cap is provided for containing a correction liquid, and the cap has a brush formed thereon, and the cap is normally tighten to seal the container and prevent the correction liquid from being dried and keep the brush to be dipped in the correction liquid. When use, the cap is removed, and the brush is used to coat the correction liquid onto a correcting surface. However, there is a drawback that users have to put the brush into the container repeatedly and the container may be overturned easily.

To overcome the aforementioned drawback, a pen-shaped or can-shaped correction liquid is introduced to facilitate users to hold and use the text correction apparatus, and the correction liquid is contained in a pen-shaped container (U.S. D648798) or a flat polygonal can-shaped container (U.S. D456844) corresponding the shape of a user's hand, and a specially designed liquid output nozzle is installed at an open end of the can container. A pressure is produced when the can container is extruded or pressed, so that the can container produces a lateral deformation to output the correction liquid from the liquid output nozzle in order to coat the correction liquid onto a correcting surface for a text correction. Although the apparatus can be used continuously to improve the convenience of use, users have to apply a force downward to abut the liquid output nozzle against the correcting surface in an actual operation, and apply a lateral compression on the can container to produce a partial deformation for outputting the correction liquid. Since the force applying directions are different, the operation does not go smoothly. In addition, the can container has a relatively small deformation, so that the correction liquid may not be squeezed out easily, particularly in cold and humid countries.

SUMMARY OF THE INVENTION

It is a primary objective of the present invention to provide a palm-pressing text correction apparatus manufactured according to the shape of a user's hand, so that the user can hold the apparatus within the user's palm operating range and change the deformation of an elastic container precisely by the pressing force produced by holding the apparatus. Since the deformation is large, therefore the operation is more intuitive, convenient and effort-saving. In addition, the separate design of the elastic container and the casing facilitates replacement, repair and maintenance and avoid unnecessary waste of materials to comply with the environmental protection requirements.

To achieve the aforementioned objectives, the present invention provides a palm-pressing text correction apparatus, comprising: a casing, having a first opening and a second opening formed at both ends of the casing respectively; an elastic container, mounted into the casing, and having the correction liquid filled in the elastic container, a liquid output nozzle disposed at an end of the elastic container, and a pressed end formed at the other end of the elastic container, so that the liquid output nozzle is protruded out from the first opening; and a pressing element, coupled to the pressed end, for producing an axial force by a pressing force and applying the axial force to the pressing element to compress and deform the elastic container in an axial direction parallel to the liquid output nozzle to output the correction liquid, so that the correction liquid can flow out from the liquid output nozzle to perform a text correction.

In a preferred embodiment, the casing is comprised of a front casing and a rear casing, and the first opening is disposed at an end of the front casing, and the other end of the front casing is integrated with an end of the rear casing, and the second opening is disposed at the other end of the rear casing and provided for covering the elastic container therein.

In addition, the elastic container and the pressing element can be connected by the following methods: 1. The pressed end of the elastic container has an outer thread, and the pressing element contains an inner thread formed therein and corresponding to the outer thread for screwing and coupling the pressing element to the elastic container. 2. The pressing element has a push rod installed therein and corresponding to the pressed end, so that the push rod normally abuts and connects the elastic container.

The palm-pressing text correction apparatus further comprises a plurality of bumps formed between an internal wall of an opening of the pressing element and an external wall of the second opening for reducing the gap between the pressing element and the casing to improve the stability of the motion. In addition, the bumps will not have too much contact with the external wall of the casing, so that the friction of the relative motion can be reduced to make the motion more smoothly.

The palm-pressing text correction apparatus further comprises a plurality of wrinkles formed at the middle section of the elastic container and disposed with an interval apart from each other, and when the wrinkles are compressed by an axial force, the intervals of the wrinkles are stacked together, and after the axial force is released, a resilience restores the wrinkles to their original positions.

DETAILED DESCRIPTION OF THE PREFERRED EMBODIMENTS

Figure 1:
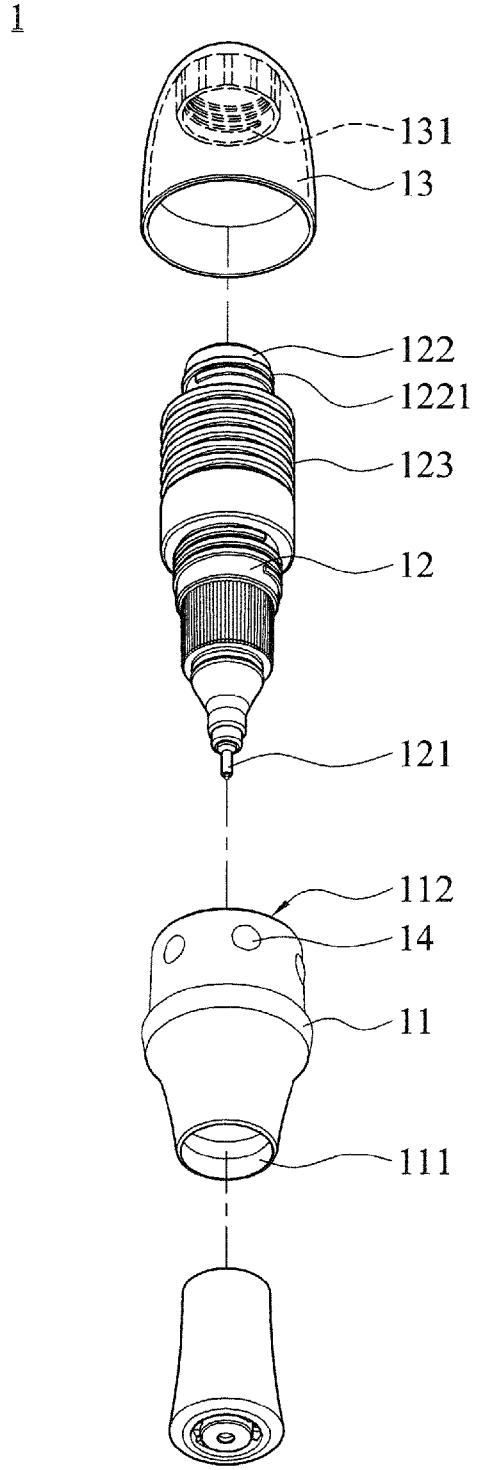
FIG. 1 is an exploded view of a preferred embodiment of the present invention.
Figure 2:
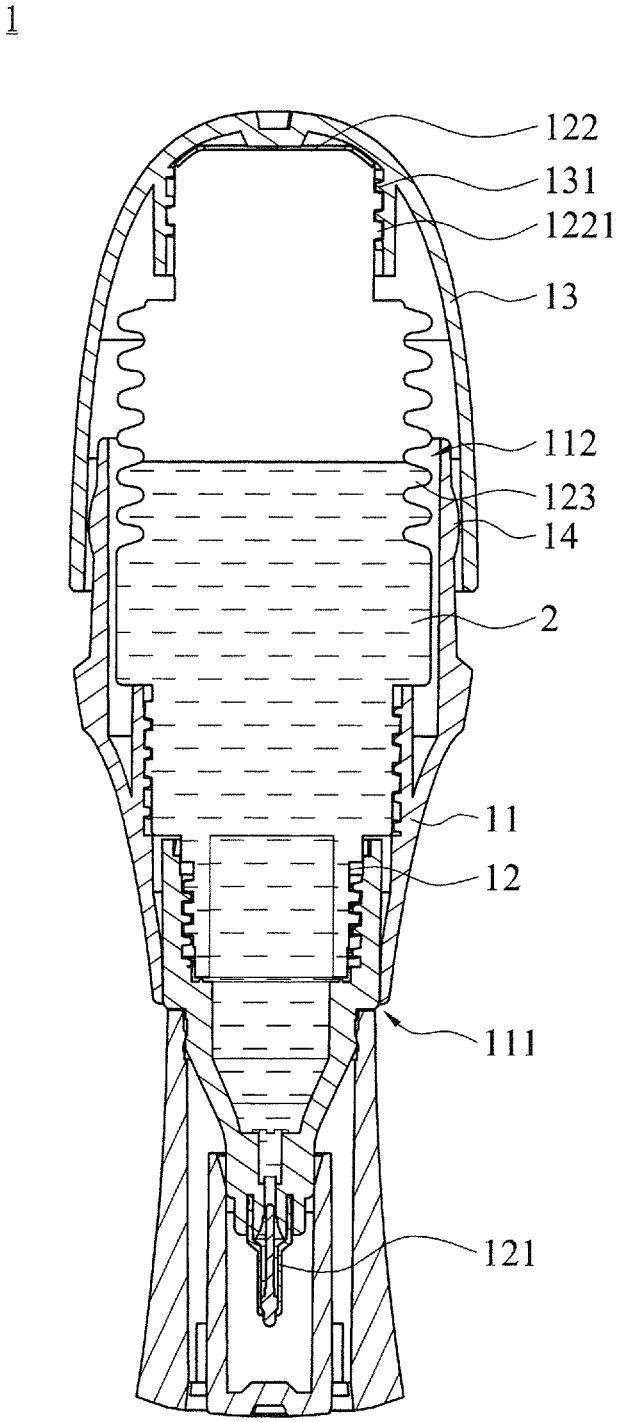
FIG. 2 is a schematic view of a structure of another implementation mode of a preferred embodiment of the present invention.

The technical content of the present invention will become apparent with the detailed description of preferred embodiments and the illustration of related drawings as follows.

With reference to FIGS. 1 to 6 for exploded views and schematic views of different implementation modes of a palm-pressing text correction apparatus 1, and a schematic view of a using status and a schematic view of actions of the elastic container in accordance with a preferred embodiment of the present invention respectively, the palm-pressing text correction apparatus 1 comprises a casing 11, an elastic container 12 and a pressing element 13.

The casing 11 is a circular tubular structure made of a hard plastic material, and having a first opening 111 and a second opening 112 formed at both ends of the casing 11 respectively, and the second opening 112 is disposed on the axis of the first opening 111.

The elastic container 12 is fixed into the casing 11 by screwing and provided for filling a correction liquid 2, and a liquid output nozzle 121 is disposed at an end of the elastic container 12, and a pressed end 122 is formed correspondingly at the other end of the elastic container 12, and the liquid output nozzle 121 is protruded out from the first opening 111. The elastic container 12 has a plurality of wrinkles 123 formed at the middle section of the elastic container 12 and disposed with an interval apart from each other to form a reciprocating telescopic lantern structure. When the wrinkles 123 are compressed by an axial force, the intervals of the wrinkles 123 are stacked and shortened. After the axial force is released, the resilience restores the original positions of the wrinkles 123. In this preferred embodiment, an outer thread 1221 is formed at the exterior of the pressed end 122.

The pressing element 13 includes an inner thread 131 formed inside the pressing element 13 and corresponding to the outer thread 1221, and the pressing element 13 is coupled to the pressed end 122 by screwing. In addition, a plurality of bumps 14 is formed between an internal wall of the opening of the pressing element 13 and an external wall of the second opening 112 for reducing the friction produced in the relative motion and improving the stability of the relative motion.

It is noteworthy that the shape and length of the present invention are designed according to the shape of a user's hand. In particular, the length falls within a range of 5 cm-10 cm to facilitate users to hold the apparatus and operate the apparatus within the operating range of the user's palm. Therefore, an axial force is created by a pressing force when the user holds the apparatus, and the axial force applied to the pressing element 13 compresses the elastic container 12 to deform in the axial direction of the liquid output nozzle 121, so that the liquid output nozzle 121 can abut a correcting surface and allow the correction liquid to flow out to perform text correction. Since the axial force causing deformation of the elastic container 12 is created naturally when the user holds the text correction apparatus in his/her hand, it is effortless to use the text correction apparatus according to the present invention. And a precise quantity of outputted correction liquid can be controlled easily to provide a very convenient and intuitive application.

Figure 3:
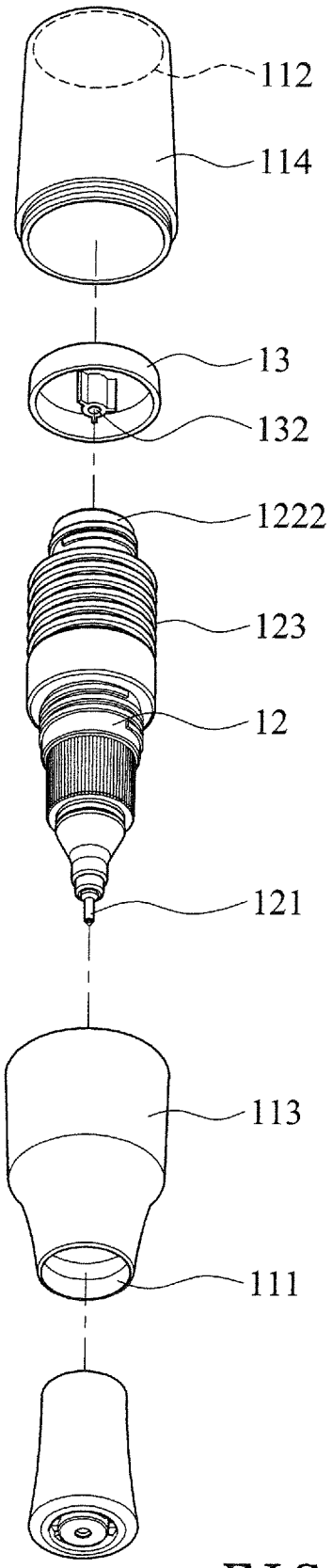
FIG. 3 is another exploded view of a preferred embodiment of the present invention.

With reference to FIG. 3 for another implementation mode of the present invention, the casing 11 is comprised of a front casing 113 and a rear casing 114, and the first opening 111 is disposed at an end of the front casing 113, and the other end of the front casing 113 is screwed to an end of the rear casing 114 to form an integrated body, and the elastic container 12 is covered and fixed therein, so that the second opening 112 is disposed at the other end of the rear casing 114, and the liquid output nozzle 121 of the elastic container 12 protrudes out from the first opening 111, and the pressed end 122 protrudes out from the second opening 112. In addition, the pressing element 13 includes a push rod 132 installed in the pressing element 13 and corresponding to the pressed end 122, so that the push rod 132 normally abuts and connects the elastic container 12. In actual tests, a better resilience can be achieved by designing the wrinkles 123 at the middle section of the elastic container 12 as a continuous thread. The wrinkles 123 can help the elastic container 12 to restore to its original shape faster so that the air can flow back into the elastic container 12 faster after it is compressed. This will, in turn, improve the outflow of the correction liquid 2 in the proceeding usages.

Figure 4:
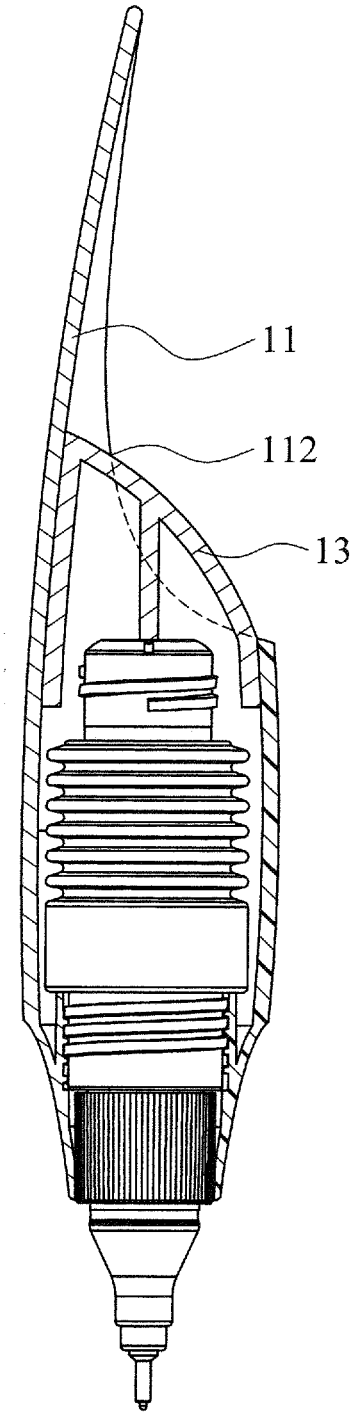
FIG. 4 is a schematic view of a structure of a further implementation mode of a preferred embodiment of the present invention.
Figure 5:
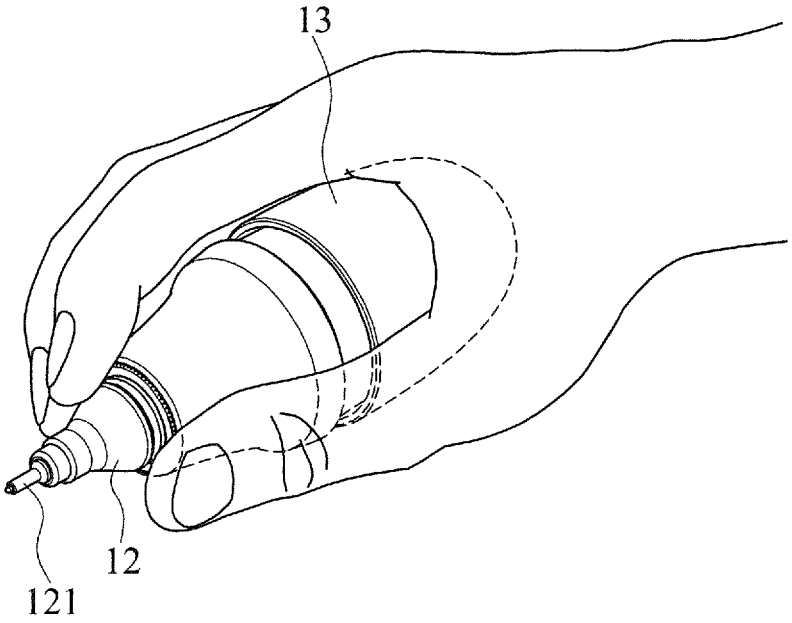
FIG. 5 is a schematic view of a using status of a preferred embodiment of the present invention.
Figure 6:
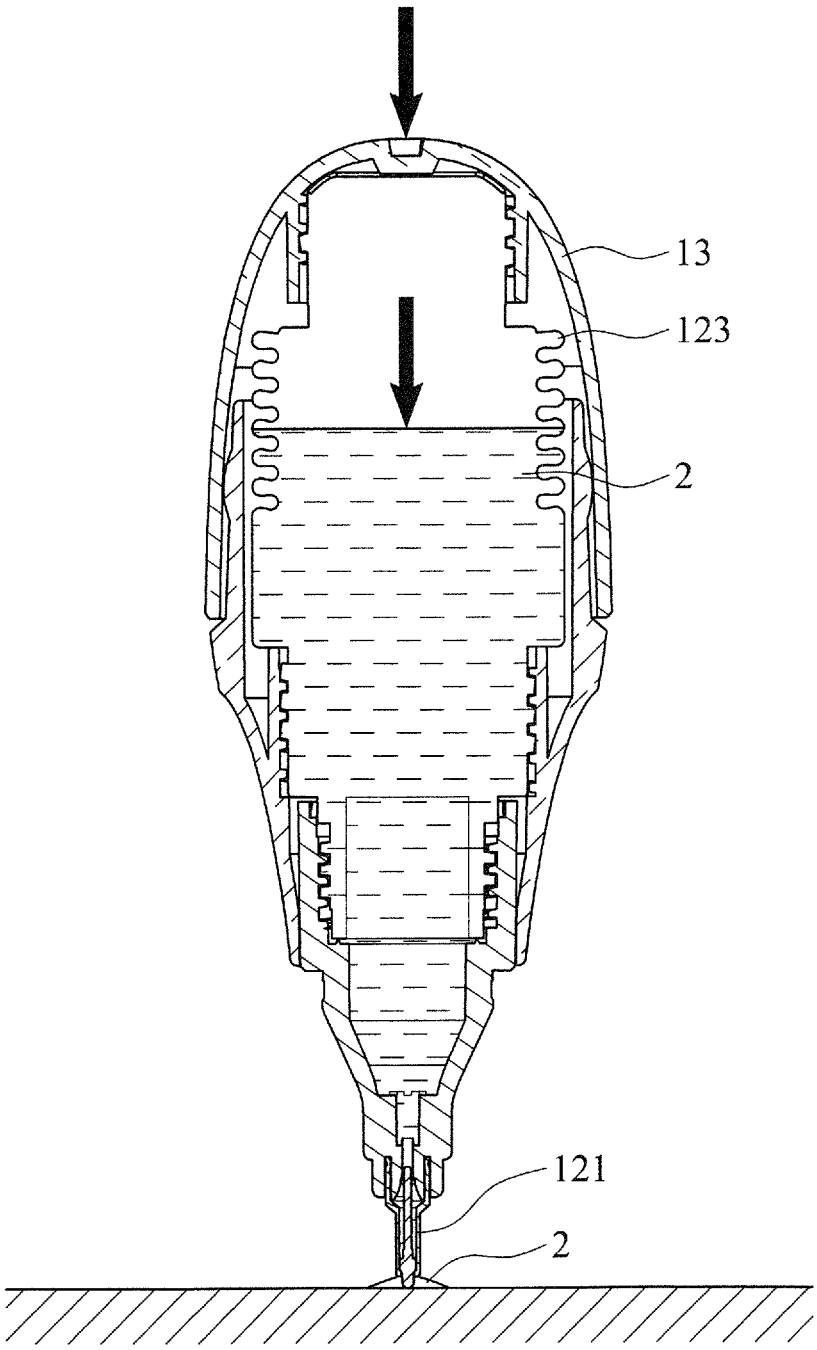
FIG. 6 is a schematic view of actions of an elastic container during the use of a preferred embodiment of the present invention.

With reference to FIG. 4 for a further implementation mode of the present invention, the casing 11 is manufactured into a pen shape, and the second opening 112 is disposed at a side of a middle rear section of the casing 11, so that the pressing element 13 is disposed at a position corresponding to a user's thumb web, so that when the palm-pressing text correction apparatus is used, the user holds the apparatus and uses a part of the palm (such as the thumb web) to control the output of the correction liquid, so as to achieve the same convenient and intuitive application.

What is claimed is:

1. A palm-pressing text correction apparatus, held within a palm operating range for the use of the palm-pressing text correction apparatus, and a rear pressing force produced by holding the palm-pressing text correction apparatus being used for controlling the output of a correction liquid, comprising:

a casing, having a first opening and a second opening formed at both ends of the casing respectively;

an elastic container, mounted into the casing, and having the correction liquid filled in the elastic container, a liquid output nozzle disposed at an end of the elastic container, and a pressed end formed at the other end of the elastic container, so that the liquid output nozzle is protruded out from the first opening; and a pressing element, coupled to the pressed end, for producing an axial force by a rear pressing force and applying the axial force to the pressing element to compress and deform the elastic container in an axial direction parallel to the liquid output nozzle to output the correction liquid, so that the correction liquid can flow out from the liquid output nozzle to perform a text correction, wherein the elastic container has an outer thread formed at the pressed end of the elastic container, and the pressing element has an inner thread formed therein and corresponding to the outer thread for screwing and coupling the pressing element onto the elastic container.

2. The palm-pressing text correction apparatus of claim 1, wherein the casing is comprised of a front casing and a rear casing, and the first opening is disposed at an end of the front casing, and the other end of the front casing is integrated with an end of the rear casing, and the second opening is disposed at the other end of the rear casing.

3. The palm-pressing text correction apparatus of claim 2, wherein the elastic container has an outer thread formed at the pressed end of the elastic container, and the pressing element has an inner thread formed therein and corresponding to the outer thread for screwing and coupling the pressing element onto the elastic container.

4. The palm-pressing text correction apparatus of claim 1, further comprising a plurality of bumps formed between an internal wall of an opening of the pressing element and an external wall of the second opening.

5. The palm-pressing text correction apparatus of claim 3, further comprising a plurality of bumps formed between an internal wall of an opening of the pressing element and an external wall of the second opening.

6. The palm-pressing text correction apparatus of claim 1, wherein the pressing element includes a push rod installed therein and corresponding to the pressed end, so that the push rod normally abuts and connects the elastic container.

7. The palm-pressing text correction apparatus of claim 2, wherein the pressing element includes a push rod installed therein and corresponding to the pressed end, so that the push rod normally abuts and connects the elastic container.

8. The palm-pressing text correction apparatus of claim 1, further comprising a plurality of wrinkles formed at the middle section of the elastic container and disposed with an interval apart from each other, and when the wrinkles are compressed by an axial force, the intervals of the wrinkles are stacked together, and after the axial force is released, a resilience restores the wrinkles to their original positions.

9. The palm-pressing text correction apparatus of claim 8, wherein the wrinkles are in the form of a continuous thread.

10. The palm-pressing text correction apparatus of claim 1, wherein the casing is manufactured into the shape of a pen, and the second opening is disposed on a lateral side of a middle rear section of the casing.

* * * * *